US007866593B2

(12) United States Patent
Friesen et al.

(10) Patent No.: US 7,866,593 B2
(45) Date of Patent: Jan. 11, 2011

(54) TWO ROLL DROP FRONT TOILET TISSUE DISPENSER

(75) Inventors: Matthew Friesen, White Rock (CA); Bradley Friesen, Vancouver (CA); John Friesen, Vancouver (CA); Andrew Jackman, Langley (CA); Alexander Tramploski, Richmond (CA)

(73) Assignee: Dispensing Dynamics International Ltd, Surrey, BC (CA)

( * ) Notice: Subject to any disclaimer, the term of this patent is extended or adjusted under 35 U.S.C. 154(b) by 235 days.

(21) Appl. No.: 12/110,628

(22) Filed: Apr. 28, 2008

(65) Prior Publication Data

US 2009/0266929 A1 Oct. 29, 2009

(51) Int. Cl.
*B65H 19/10* (2006.01)

(52) U.S. Cl. ..... 242/560; 242/563.2; 242/588.6; 242/597.8

(58) Field of Classification Search ..... 242/558, 242/559, 560, 561, 588, 588.3, 588.6, 591, 242/597, 597.8, 563.2, 559.4, 559.3
See application file for complete search history.

(56) References Cited

U.S. PATENT DOCUMENTS 3,211,504 A 10/1965 Bump
3,214,014 A 10/1965 Perrin
3,381,909 A 5/1968 Tucker et al.
3,387,902 A 6/1968 Perrin et al.
3,770,222 A 11/1973 Jespersen
4,340,195 A * 7/1982 DeLuca ..... 242/560
4,662,664 A 5/1987 Wendt et al.
5,628,474 A 5/1997 Krueger et al.
5,865,395 A 2/1999 Wei
5,873,542 A 2/1999 Perrin et al.
5,954,256 A 9/1999 Niada
6,145,779 A 11/2000 Johnson et al.
6,202,956 B1 3/2001 Grasso et al.
6,237,871 B1 5/2001 Morand et al.
6,508,432 B2 1/2003 Krivulin
7,182,288 B2 2/2007 Denen et al.
2008/0078855 A1 * 4/2008 Forman et al. ..... 242/560

* cited by examiner

*Primary Examiner*—William E Dondero
(74) *Attorney, Agent, or Firm*—Dwayne E. Rogge; Hughes Law Firm, PLLC

(57) ABSTRACT

A two-roll dispenser is disclosed for a plurality rolls of products, in one embodiment a plurality of toilet paper rolls. The operation of resetting the device to accept replacement rolls of product is achieved by opening and re-closing the casing. The seer mechanism is also disclosed, maintaining a casing door in a reserve position until a primary roll of product is substantially consumed. In one form, rolls of product having a partial or split core are utilized to achieve the objects of this disclosure.

12 Claims, 20 Drawing Sheets

TWO ROLL DROP FRONT TOILET TISSUE DISPENSER

BACKGROUND OF THE DISCLOSURE a) Field of the Disclosure

This disclosure relates to the field of dispensing sheet product, and in particular to dispensing rolls of toilet tissue. One form of the disclosure pertains to dual-roll dispensers wherein a plurality of rolls of product are disposed on a plurality of cores. In one specific example, the disclosure relates to dispensers wherein each roll is at a fixed position and the door is provided to allow access to a secondary roll when a primary roll is substantially consumed.

b) Background Art

Several dual-roll paper product dispensers have been conceived. These prior art references have varying degrees of applicability and varying degrees of success in restricting access to a secondary roll until a primary roll is substantially consumed, and often require many steps to gain access to consumed rolls to facilitate restocking.

SUMMARY OF THE DISCLOSURE

The dispenser in one embodiment disclosed herein is a paper product dispenser for dispensing product on a plurality of rolls. One roll will be termed a primary roll and another roll will be termed a secondary roll. Each of these rolls could be substantially the same in configuration, but will be different in their orientation once installed in the dispenser. In such paper product dispensers, it is desired to reduce waste and the frequency with which service personnel must replace the product in order to reduce costs, etc. Thus it is desired that a primary roll of product be accessible to the user until it is substantially or completely consumed, at which point the user would gain access to the secondary roll of product.

In one embodiment disclosed herein, a user is prohibited from accessing the secondary roll of product by way of a portion of the casing which is positioned between the user and the secondary roll of product until the primary roll of product is substantially or completely consumed. When the primary roll is consumed, a swing arm which generally rests on the outer surface of the primary roll of product releases a seer latch which in turn releases a portion of the casing to allow the user to access the secondary roll product. To accomplish this, the swing arm may be provided with an extension which rests upon the outer surface of the primary roll of product, and when the product is substantially consumed, this extension repositions radially inward from the outer surface of the core of the primary roll of product.

Once the primary roll is consumed and at least a portion of the secondary roll has been consumed, it may be desired to reposition the secondary roll to the primary roll position and then replace the secondary roll of product with a new or replacement roll of product. Thus it may be desired to have an automatic reset such that when the casing is opened, a reset mechanism is engaged which resets the seer latch, repositions the swing arm, and/or repositions the casing door. This automatic reset allows the service personnel to reposition or replace the secondary roll of product and nearly simultaneously replace the primary roll of product with a minimum of effort and time.

A paper product dispenser for dispensing product on a plurality of rolls is disclosed in one form having a primary roll and a secondary roll. The dispenser includes a lateral extension having a face side, a back side, and a first end, the lateral extension coupled at the first end to the face side of the frame and extending therefrom. A primary roll support is provided, fixedly coupled to the lateral extension and extending transversely from the face of the lateral extension, operatively configured to support the primary roll of product. A secondary roll support is also provided, extending transversely from the face of the lateral extension, operatively configured to support the secondary roll of product. A casing door is provided, configured to deny access to the secondary roll of product until the primary roll of product is substantially consumed. This arrangement reduces wasted product. The casing door comprises a release latch to maintain the door in position to prohibit a user from accessing the secondary roll of product until the primary roll is consumed. A swing arm may also be provided, extending transversely from the lateral extension. In this embodiment, the swing arm is configured to engage the outer surface of the primary product roll positioned upon the primary roll support and rotate about an pivot point of the lateral extension as the primary roll of product is consumed. Additionally, the swing arm may be configured to be repositioned to a reserve position, followed by repositioning the casing door to a reserve position, functionally resetting the dispenser automatically as the casing is opened. In this embodiment, the swing arm may include an engagement portion, operatively configured to release the seer latch and thus open the casing door only when the primary roll is completely utilized.

The paper product dispenser may also be configured wherein the swing arm is rotatably coupled to the frame at a first end of the lower member. This may be accomplished via a lower member pivot. Additionally, the lower member may include a channel, substantially at a second end of the lower member, configured to slidably engage the upper member wherein the channel of the lower member directly engages the swing arm. In one embodiment, the swing arm extends transversely from the upper member through a surface defining a channel disposed upon the lateral extension. The swing arm in one form further includes an engagement portion operatively configured to engage the outer surface of the primary product roll until the primary product roll is substantially consumed, at which point the seer latch is released and the casing door is repositioned to an open position.

The paper product dispenser in one embodiment may further include an upper member which is rotatably coupled to the back side of the lateral extension. The upper member includes a cam surface slidably engaging the release latch. The upper member may include a cam surface and a seer point which are configured to slidably engage the seer latch while the primary product roll is not substantially consumed and then release once the primary roll is substantially consumed.

The paper product dispenser may also include, in one form, a casing which is rotatably attached to the frame at a casing pivot. The dispenser further includes a repositioning tab, operatively configured to engage a repositioning surface on the first end of the lower member when the casing is opened to a substantially fully open position. This repositioning of the casing will exert pressure against the repositioning surface of the lower member by the repositioning tab and will tend to rotate the lower member about the lower member pivot.

The frame and the lateral extension are formed as a unitary structure, or may be formed of separate units coupled together.

The paper product dispenser in one form includes a lifting member which is coupled at a first end to the casing door and is configured to frictionally engage the outer surface of the primary roll of product as the casing is closed. This action functions to reposition the casing door from a position where the secondary roll of product is accessible to a reserve position where only the primary roll of product is accessible.

A paper product dispenser is disclosed in one embodiment for dispensing product disposed on a plurality of hollow cores wherein the dispenser includes a seer mechanism which is coupled to the casing door and is operatively configured to reposition the casing door from a reserve position to an open position when a primary roll of product is substantially consumed. This casing door is not to be confused with the casing portion which rotates to allow replacing of the consumed rolls of product. The seer mechanism in one form is coupled to the casing and is operatively configured to reset the casing door from a usable position to a reserve position when the casing is substantially opened. Additionally, a swing arm is provided in one form, coupled to the seer mechanism and configured to engage the outer surface of the primary roll while the primary roll is being utilized. This swing arm can be operatively configured to engage the seer mechanism and open the casing door when the primary roll is substantially consumed. Optionally, the swing arm can be configured to reposition the seer mechanism when the casing is substantially opened.

In another embodiment, a paper product dispenser for dispensing products is disclosed wherein the dispenser includes a swing arm coupled to the frame which is configured to engage the outer surface of a primary roll of product while the primary roll is being utilized. The swing arm may be further coupled to the casing and may be configured to reset to a first position when the casing is opened.

A method for restocking a paper product dispenser is disclosed involving the steps of first opening the casing of the dispenser. The dispenser may be configured to automatically reset the release latch, thus removing a step that is usually performed by a service person. Next, any consumed cores on the primary roll support should be removed. The service person could also replace the consumed secondary roll core with a new roll of product. Then the consumed primary core should be replaced with a substantially full roll of product. Alternatively, the full roll of product placed upon the primary roll support may be the remainder of the product left on the core previously engaged upon the secondary roll support. The service person would then close the casing of the dispenser.

DESCRIPTION OF THE PREFERRED EMBODIMENTS

Figure 1:
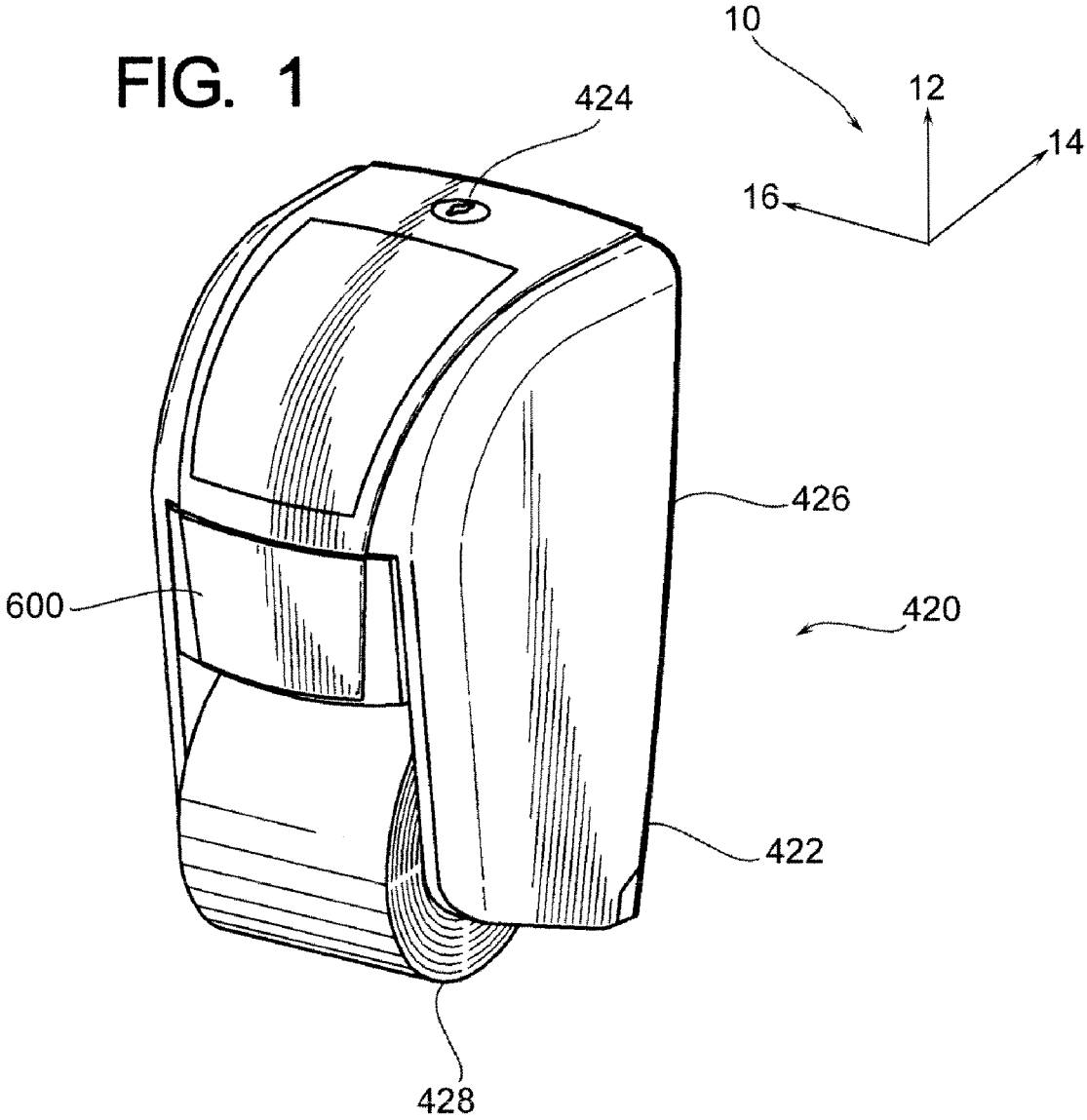
FIG. 1 is an isometric view of one embodiment of the disclosure in a closed position.
Figure 2:
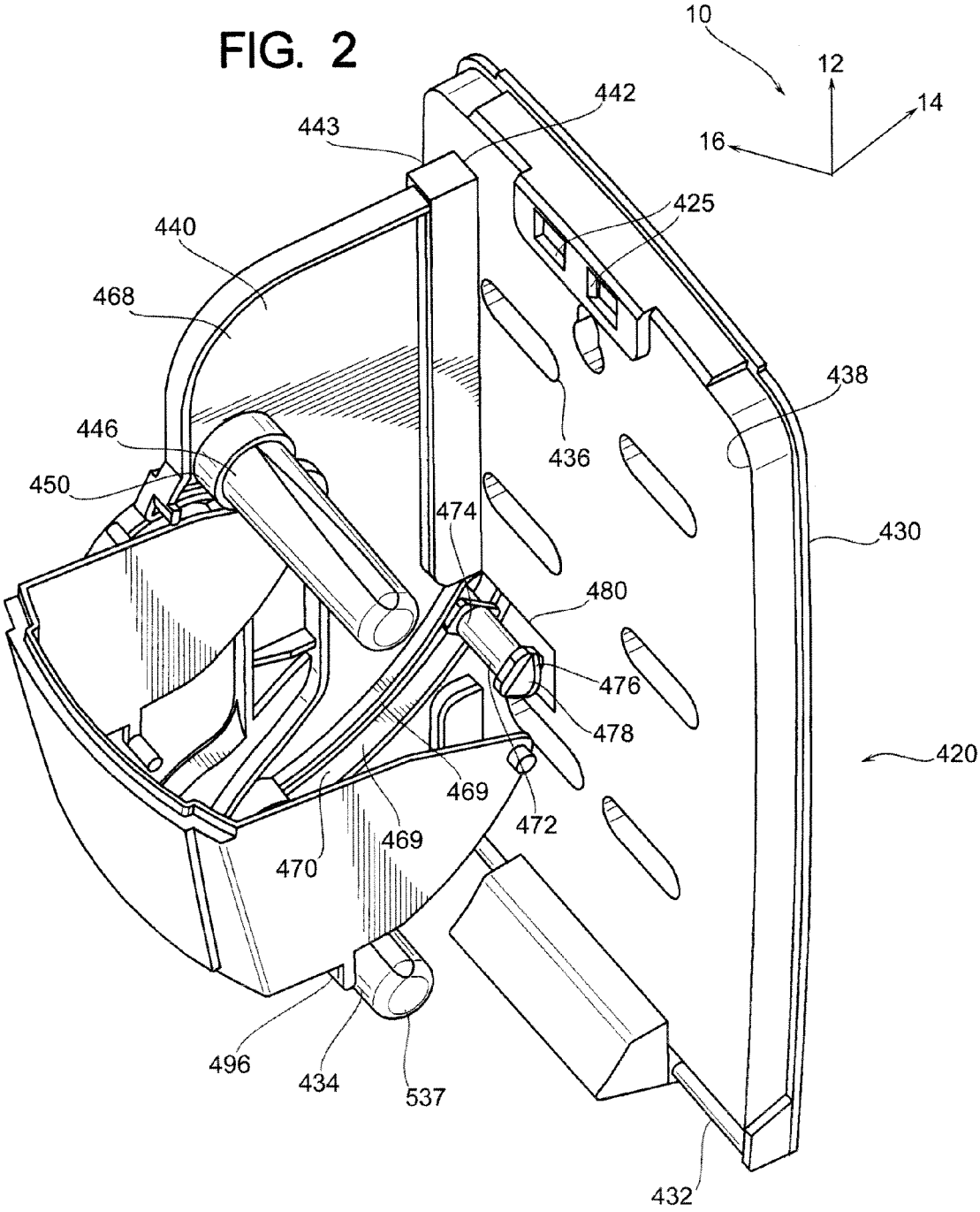
FIG. 2 is an isometric view of one embodiment of the disclosure from the left side with the casing and product rolls removed to show the mechanism.

To simplify the description and improve understanding, an axis system 10 is disclosed in FIG. 1 and again in FIG. 2 showing a vertical axis 12, a lateral axis 14, and a transverse axis 16. The arrow indicated at 12 generally shows an upward vertical direction as the arrow at 16 generally shows a rightward direction. Of course, this axis system and disclosed orientations are for understanding of the apparatus and should in no way be construed as limiting.

Looking at FIG. 1 is shown one embodiment of a dispenser 420, including a casing 422 and a latching mechanism 424. As shown, the dispenser 420 is in the closed position and is ready for operation. The back side 426 of the casing 422 could be attached to a structure such as a wall or door. A product roll 428 is shown which in one form is a roll of toilet paper. Obviously, the dispenser 420 can be scaled to fit other rolls such as paper towels or the like.

Looking at FIG. 2 is shown the dispenser 420 in one form with the casing 422 and product roll 428 removed. The casing in one form could normally be rotatably attached to the frame 430 at the casing pivot 432. In one form the casing pivot 432 is at the vertically lowermost extreme of the frame 430. The product roll 428 of FIG. 1 could be disposed upon the primary roll support 434. As previously mentioned, a latching mechanism 424 is shown at the vertically upward portion of the frame 430. The latching mechanism 424 engages the surfaces defining openings 425 near the topmost portion of the frame 430. As such latching mechanisms are known in the art, many such latching mechanisms could be made to operate as desired. A plurality of mounting holes 436 are shown which could be utilized to couple the frame 430 to a structure such as a wall or door by way of fasteners such as screws, nails and the like.

One embodiment of the frame 430 includes a face side 438. Attached to the face side 438 of frame 430 is a lateral extension 440. The lateral extension is substantially a vertical wall-like structure having a first end 442 coupled to the face side 438 of the frame 430. In the embodiment shown in FIG. 2, the lateral extension 440 is attached via a box-like portion 443. The lateral extension 440 may be coupled to the face side 438 by way of frictional engagements or adhesive, or may conceivably be formed as a unitary structure. The lateral wall extension 440 provides a structure for supporting the primary roll support 434, the secondary roll support 446, and other elements 434. The primary roll support 434 may be formed as part of the lateral extension 440 or may be attached thereto by way of frictional engagements or adhesives.

Figure 4:
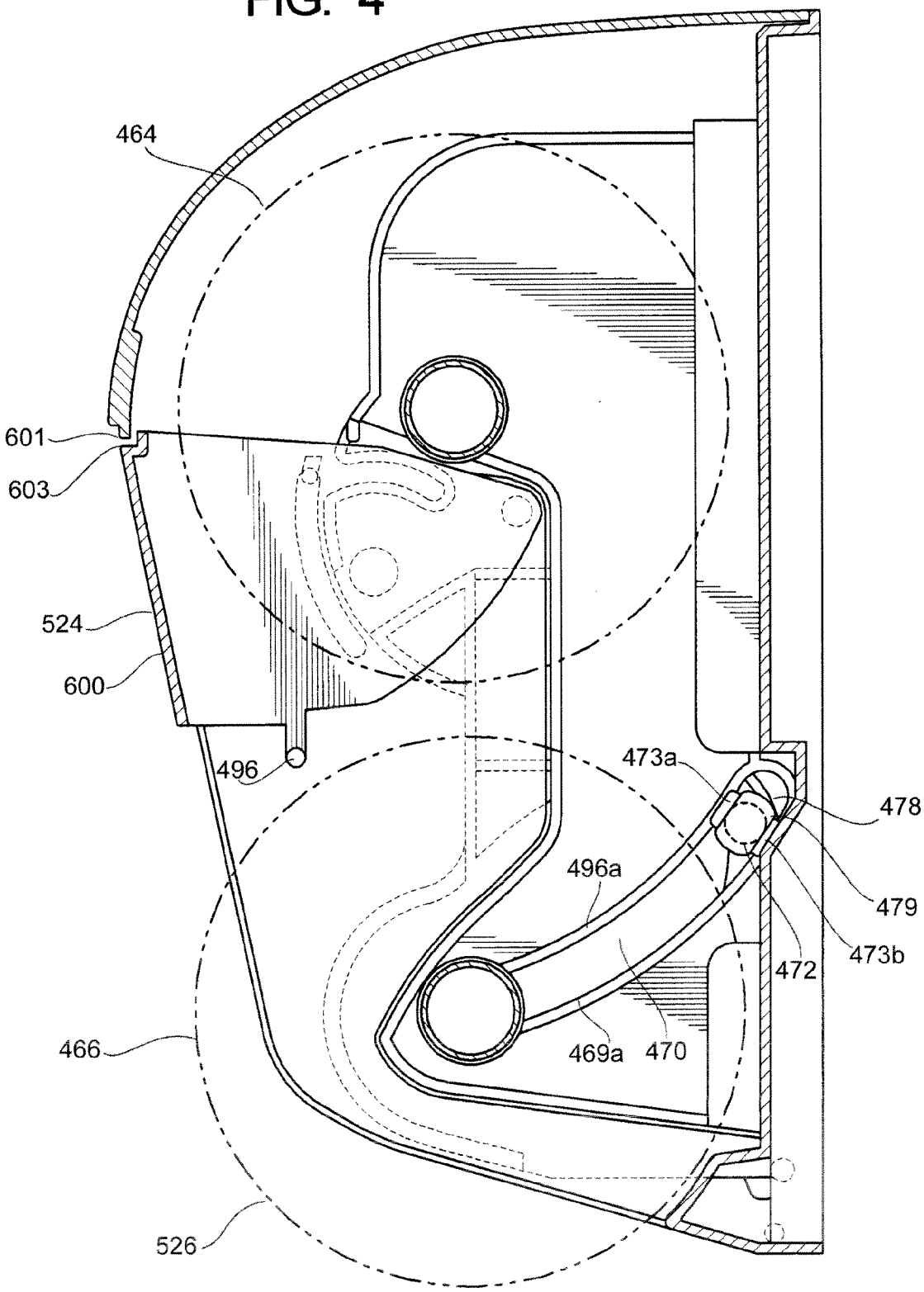
FIG. 4 is a hidden line side view of the left side of one embodiment of the disclosure in a reserve position with the primary and secondary rolls complete.
Figure 5:
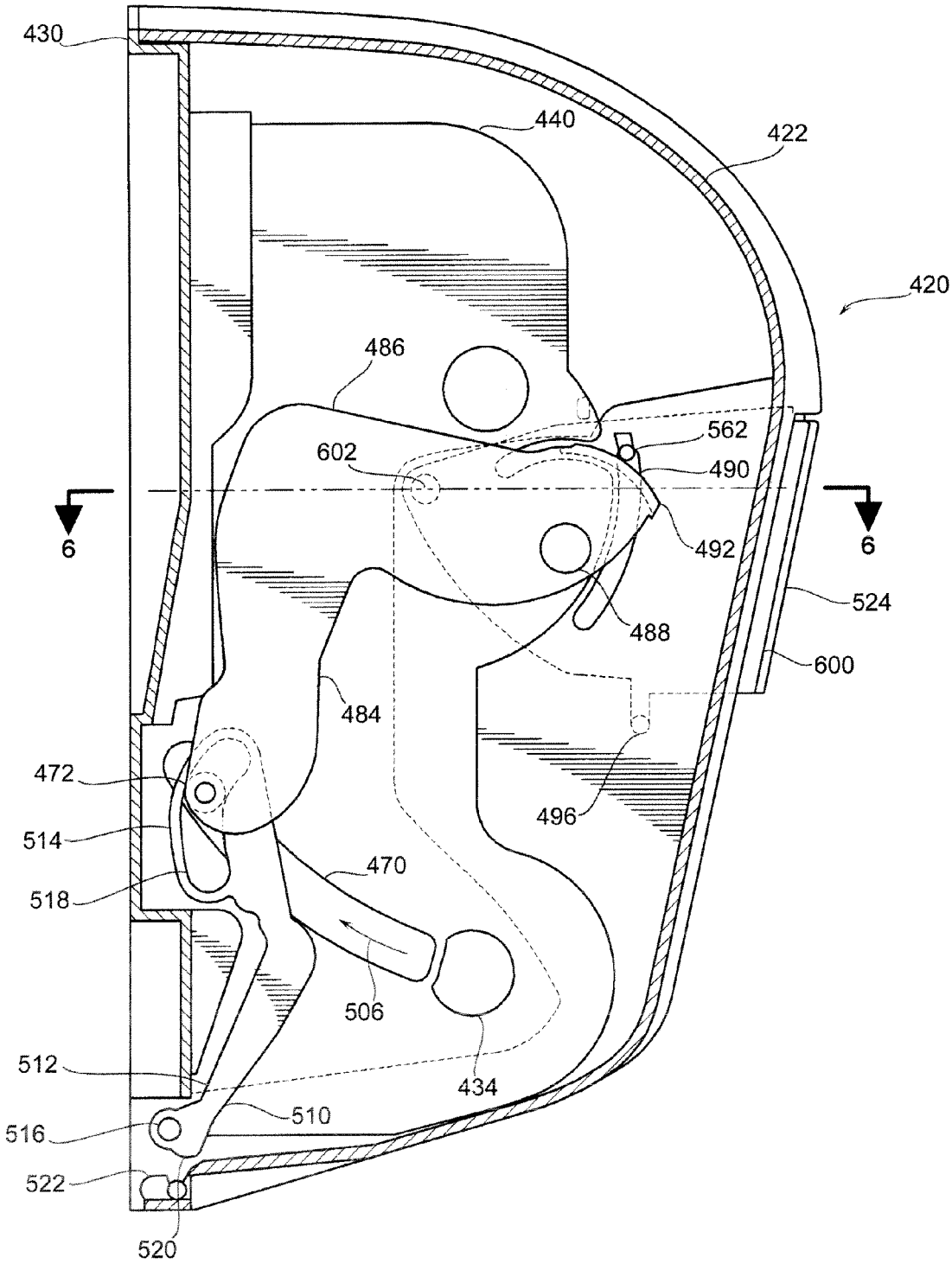
FIG. 5 is a hidden line view of the right side of one embodiment of the disclosure in a reserve position.

A secondary roll support 446 is also provided which extends transversely from the lateral extension 440 and in one form is substantially a cylinder. A secondary roll support 446 includes an extension 448 which is coupled to a secondary roll support base 450. As shown in FIG. 2, the secondary roll support 446 is configured to support a secondary product roll 464 as shown in FIG. 4. Similarly, the primary roll support 434 is configured to support a primary product roll 466. A plurality of surfaces 469 defining a channel 470 are also disposed in the lateral extension 440 configured to allow passage and movement of a swing arm 472. Referring to FIG. 5, as the swing arm 472 is attached to the upper member 484, which pivots about an upper member pivot 488, it may be convenient to have these surfaces 469 form an arc centered about the center of the upper member pivot 488. Looking again at FIG. 2, the swing arm 472 has a first end 474 near the face side 468 of lateral extension 440, and a second end 476 substantially distant from the face 468 of the lateral extension 440. The swing arm 472 furthermore has an engagement portion 478 configured to ride on the outer surface of the primary product roll 466 as the primary product roll 466 is being used. The frame 430 may also include a recess 480 upon the face side 438 configured to accept a portion of the swing arm 472 when it is in position furthermost from the primary roll support 434.

The primary roll support 434 of one embodiment may also include a channel (not shown) configured to receive a portion of the swing arm 472 when the swing arm 472 is in position closest to the primary roll support 434. As will be discussed later, when a primary product roll 466 (see FIG. 4) is used having a partial or split core as is known in the art, the engagement portion 478 of the swing arm 472 will ride along on the outer portion of the primary product roll 466 until the primary product roll 466 is substantially consumed, at which point the engagement portion 478 will press past the end of the partial core and set substantially within the channel 482. The end result of this operation will be discussed in detail.

Figure 3:
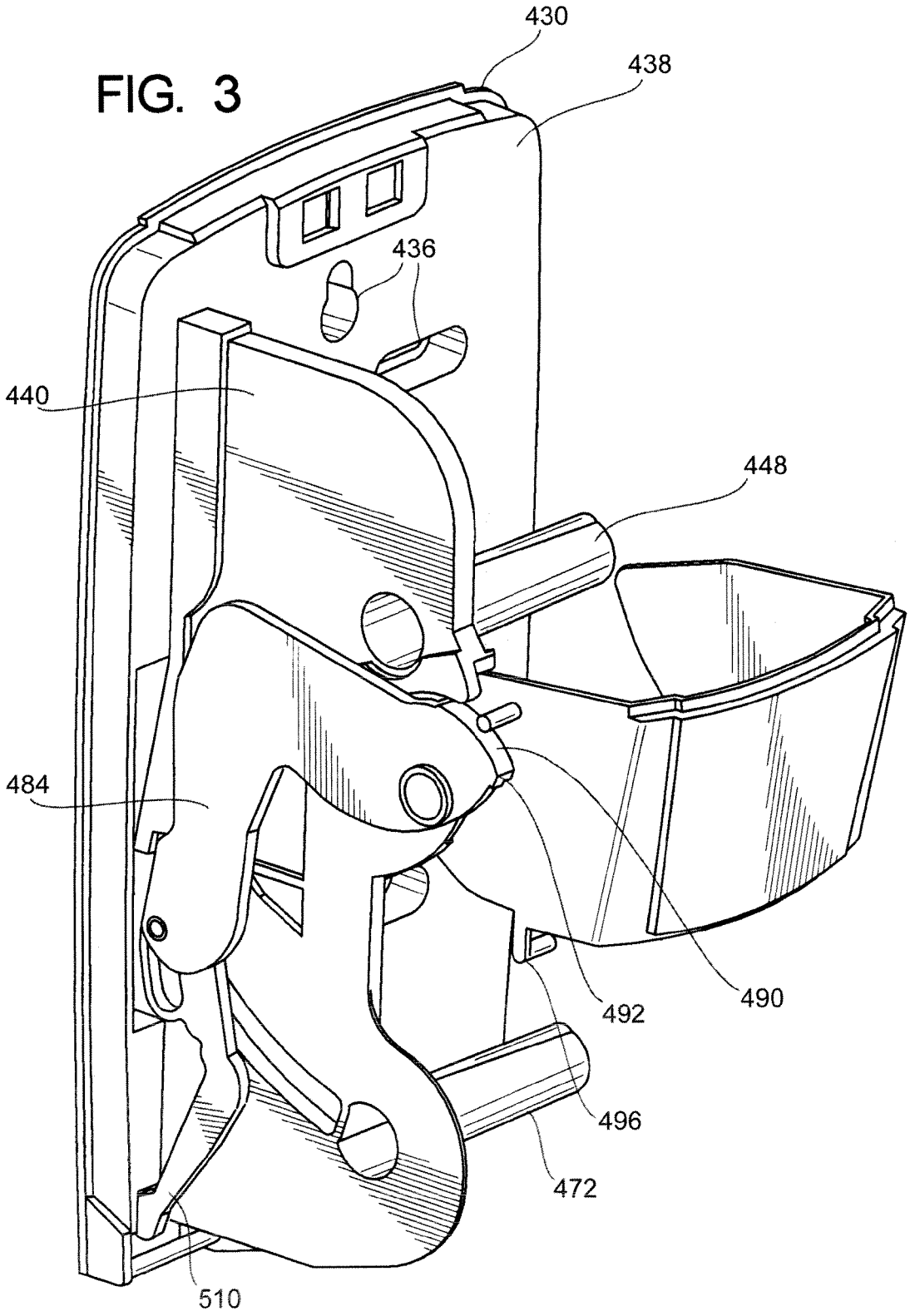
FIG. 3 is an isometric view of one embodiment of the disclosure from the right side with the casing removed to show the mechanism.
Figure 15:
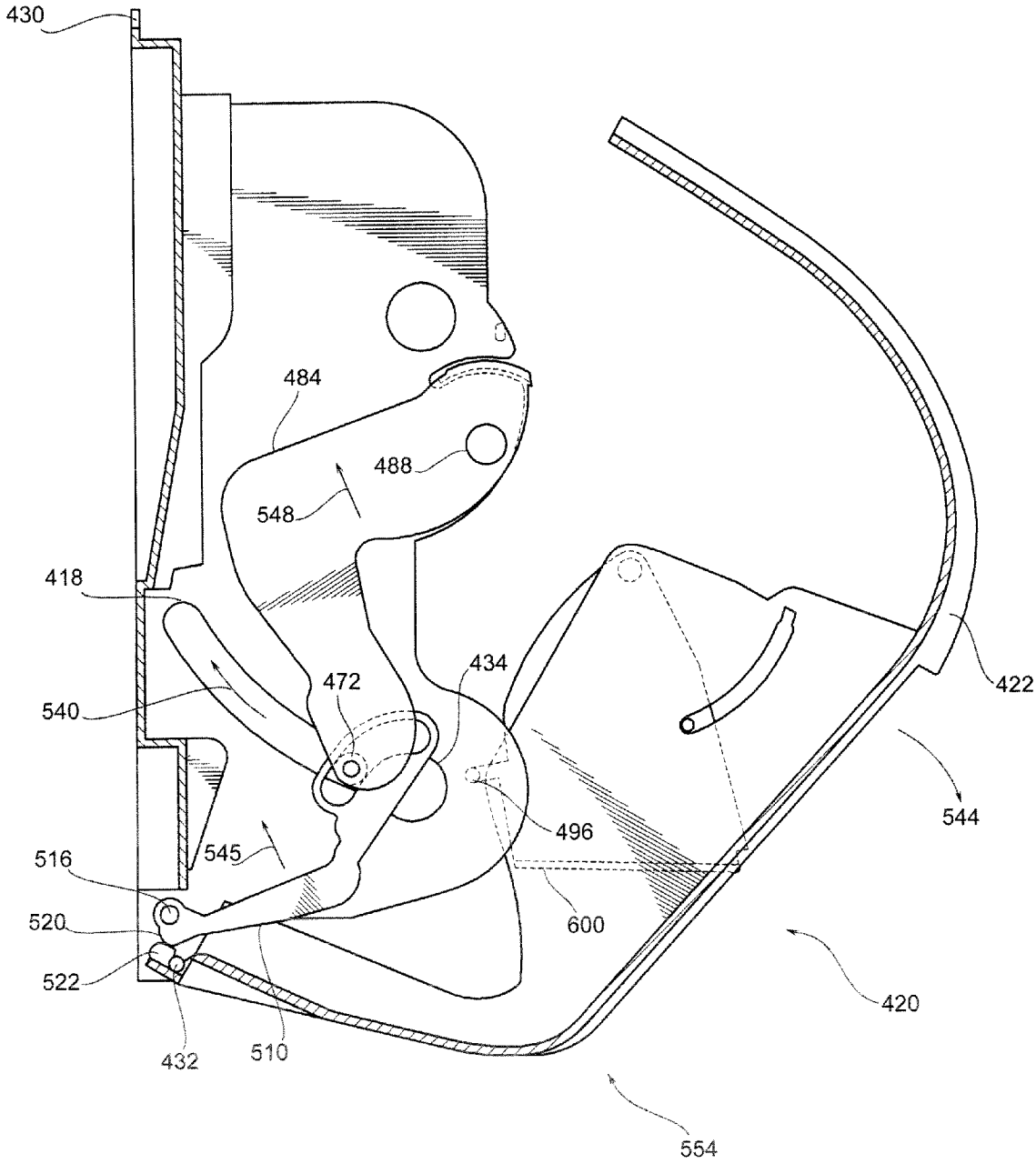
FIG. 15 is a hidden line side view of the right side of one embodiment of the disclosure in a substantially open position.
Figure 17:
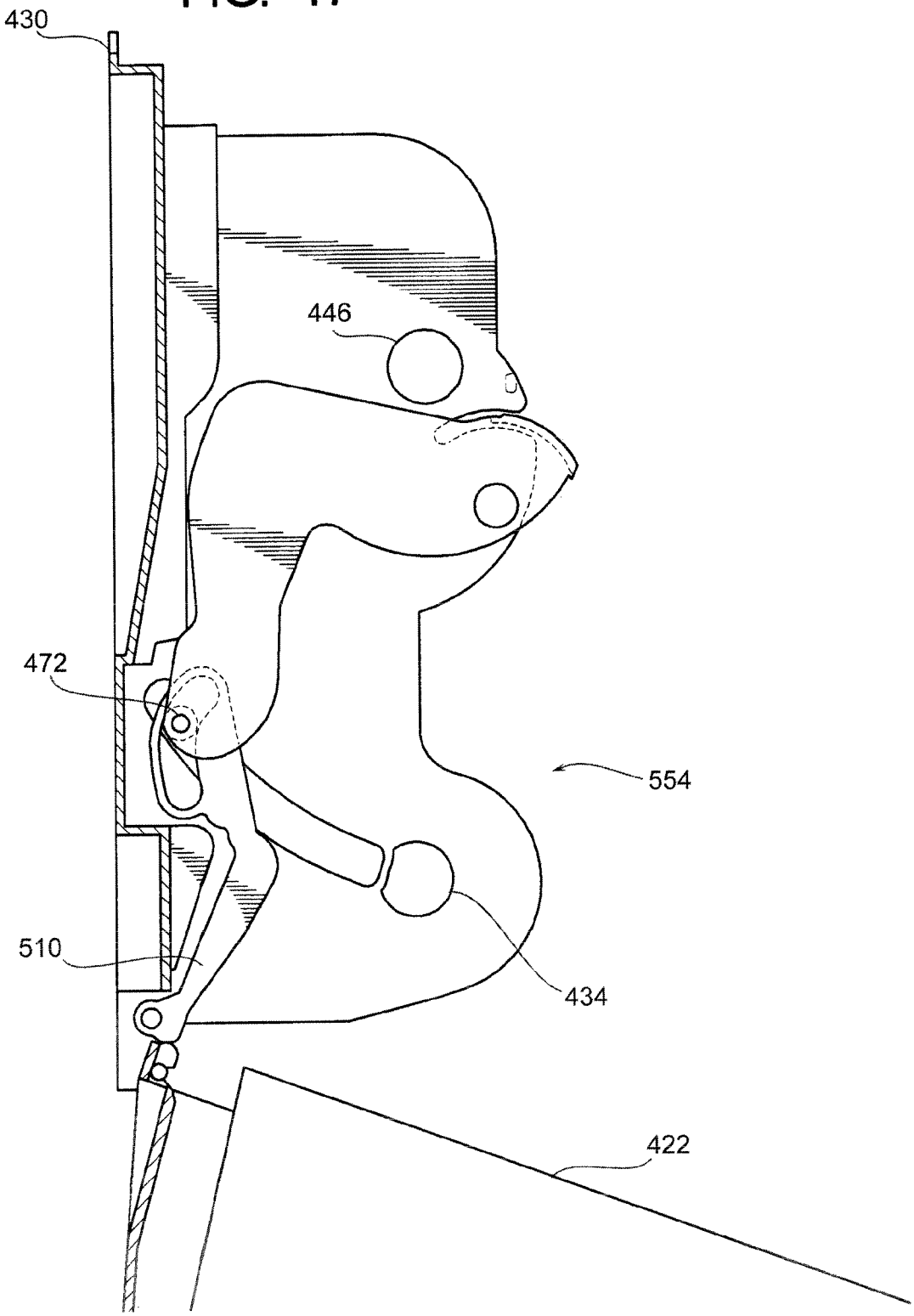
FIG. 17 is a hidden line side view of the right side of one embodiment of the disclosure in an open position with the seer mechanism reset.

Now looking at FIG. 5, a hidden line view of one embodiment of the dispenser 420 is shown including the casing 422, and the frame 430. As stated before, as the primary product roll 466 is consumed, the swing arm 472 will slide along channel 470 towards the primary roll support 434. The swing arm 472 extends transversely from the upper member 484 to ride against the primary roll of product. The upper member 484 is shown in a reserve position 486, and is coupled to the lateral extension 440 at an upper member pivot 488. The upper member 484 in one form further includes a cam surface 490 and a seer point 492. These can also be seen in FIG. 3 from a different angle. A lower member 510 is also shown in FIG. 5 having a first end 512 and a second end 514. The lower member 510 is coupled to the frame 430 at a lower member pivot 516. The lower member 510 could also be coupled to the lateral extension 440. The lower member 510 in one form further comprises a plurality of surfaces forming a channel 518 configured to engage the swing arm 472. Furthermore, the lower member 510 may comprise a reset surface 520 configured to frictionally engage a reset tab 522 when the casing is substantially opened, as is shown in FIGS. 15 and 17.

Figure 6:
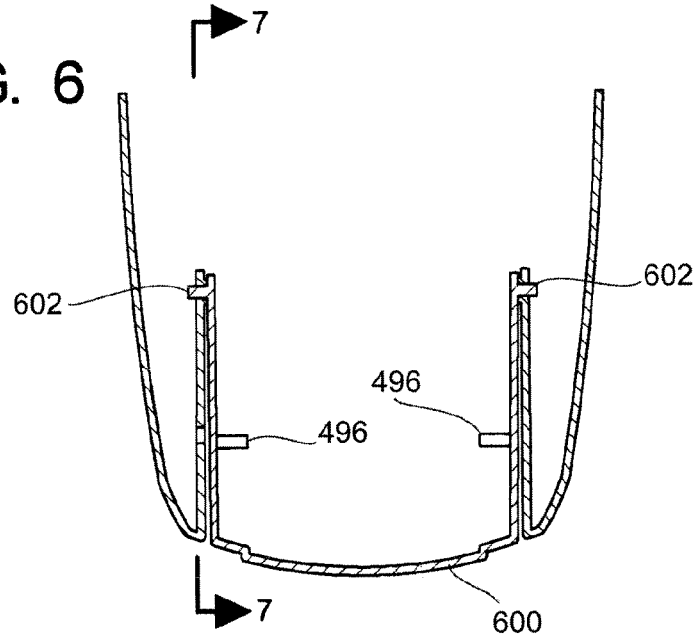
FIG. 6 is a cutaway view of one embodiment taken along line 6 of FIG. 5.
Figure 7:
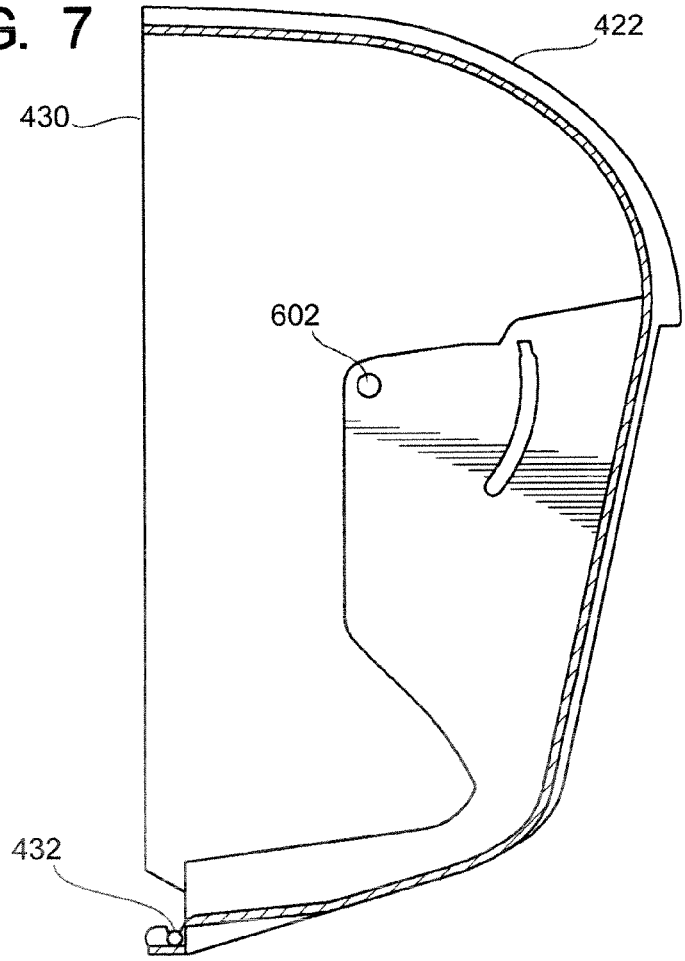
FIG. 7 is a cutaway of one embodiment taken along line 7 of FIG. 6.
Figure 12:
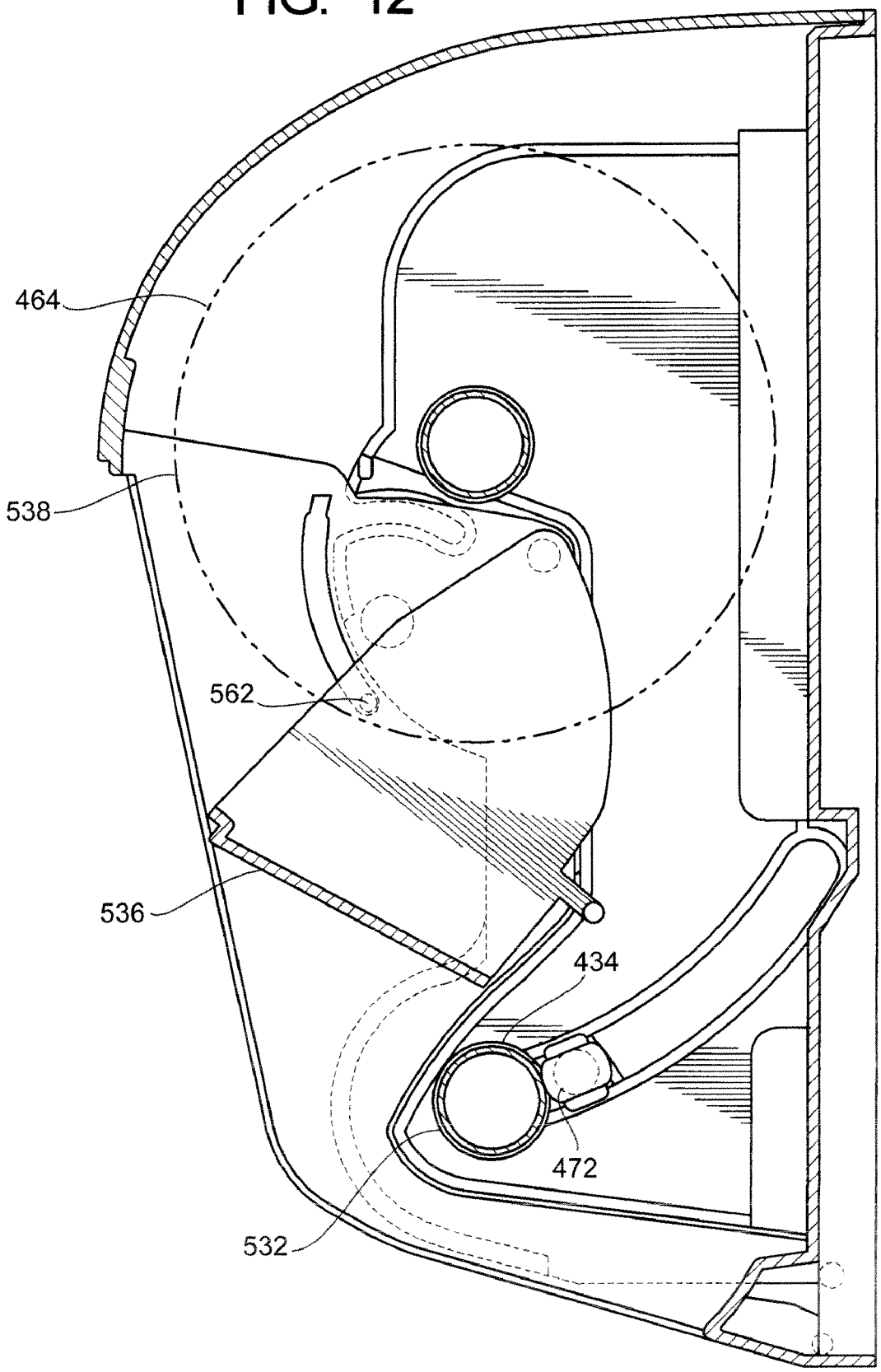
FIG. 12 is a hidden line side view of the left side of one embodiment of the disclosure and an open position with the primary roll removed and the secondary roll accessible to be utilized.

Many prior art product roll dispensers require that a person attempting to restock one or more of the product rolls would first need to reset a release (seer) latch which moves the casing door from a reserve position to an operational position, reset the mechanism which releases the casing door, and then replace either the primary or the primary and the secondary rolls of product. In one embodiment of this disclosure, a dispenser 420 is provided wherein releasing a latching mechanism 424 and opening the casing 422 about the casing pivot 432 engages the reset tab 522 against the reset surface 520 of the lower member 510. This pressure tends to rotate the lower member 510 away from the primary roll support 434 in the direction indicated at 506. The motion of the lower member 510 repositions the swing arm 472 away from the primary roll support 434 allowing the primary roll to be replaced without necessitating an additional movement of a user, manually repositioning the swing arm 472. Additionally, the dispenser 420 can be configured such that a lifting member 496 engages the outer surface 526 of the primary product roll 466, which tends to rotate the casing door 600 from an open position 536 as shown in FIG. 12, to a reserve position 524 as shown in FIG. 5. Looking at FIG. 6, it can be seen how the lifting member 496 may extend from the right and/or the left transverse portion of the casing door 600. The casing pivots 602 can also be seen clearly and are furthermore shown in FIG. 7 rotatably coupled to the casing 422. A casing door pivot 602 is provided which rotationally couples the casing door 600 to the lateral extension 440. As such, if the secondary product roll 464 and/or primary product roll 466 is substantially consumed, a user could replace it with a new unused roll. At this point the casing 422 could be closed and could reengage the latch mechanism 424, at which point the apparatus is once again ready for use. This reset mechanism would save a considerable amount of time and effort as the motion of opening and re-closing the casing 422 repositions the seer mechanism and the casing door 600 to a reserve position 524.

Looking at FIGS. 4, 8, 10, 12, 14, 16, 18, and 20, a progression of one embodiment is shown beginning with FIG. 4 wherein the primary product roll 466 is consumed, the mechanisms are engaged, and upon complete consumption of the primary product roll 466, the casing door 600 is opened providing access to a secondary product roll 464, the consumed product rolls are replaced, and the casing is re-closed. These actions reset the apparatus of the dispenser 420. Looking at FIG. 4, a primary product roll 466 is shown being a substantially new roll. When the casing door 600 is closed, the secondary product roll 466 is not available for use by a consumer. This can be seen by looking at FIG. 1, and at FIG. 4 where the casing door 600 is in the closed or reserve position 524 and the lip 601 of the casing 422 overlaps the recess 603 of the casing door 602. Also shown is the swing arm 472 including the engagement portion 478 which is in position to frictionally engage the outer surface 526 of the primary product roll 466. Obviously, friction reducing agents such as Teflon, plastic, a wheel, or other mechanisms can also be employed to reduce friction between the swing arm 472 and the outer surface 526 of the primary product roll 466. A plurality of tabs 473*a* and 473*b* may also be utilized to maintain the swing arm 472 upon the plurality of surfaces 469*a* and 469*b* to maintain their position upon the channel 470.

Figure 8:
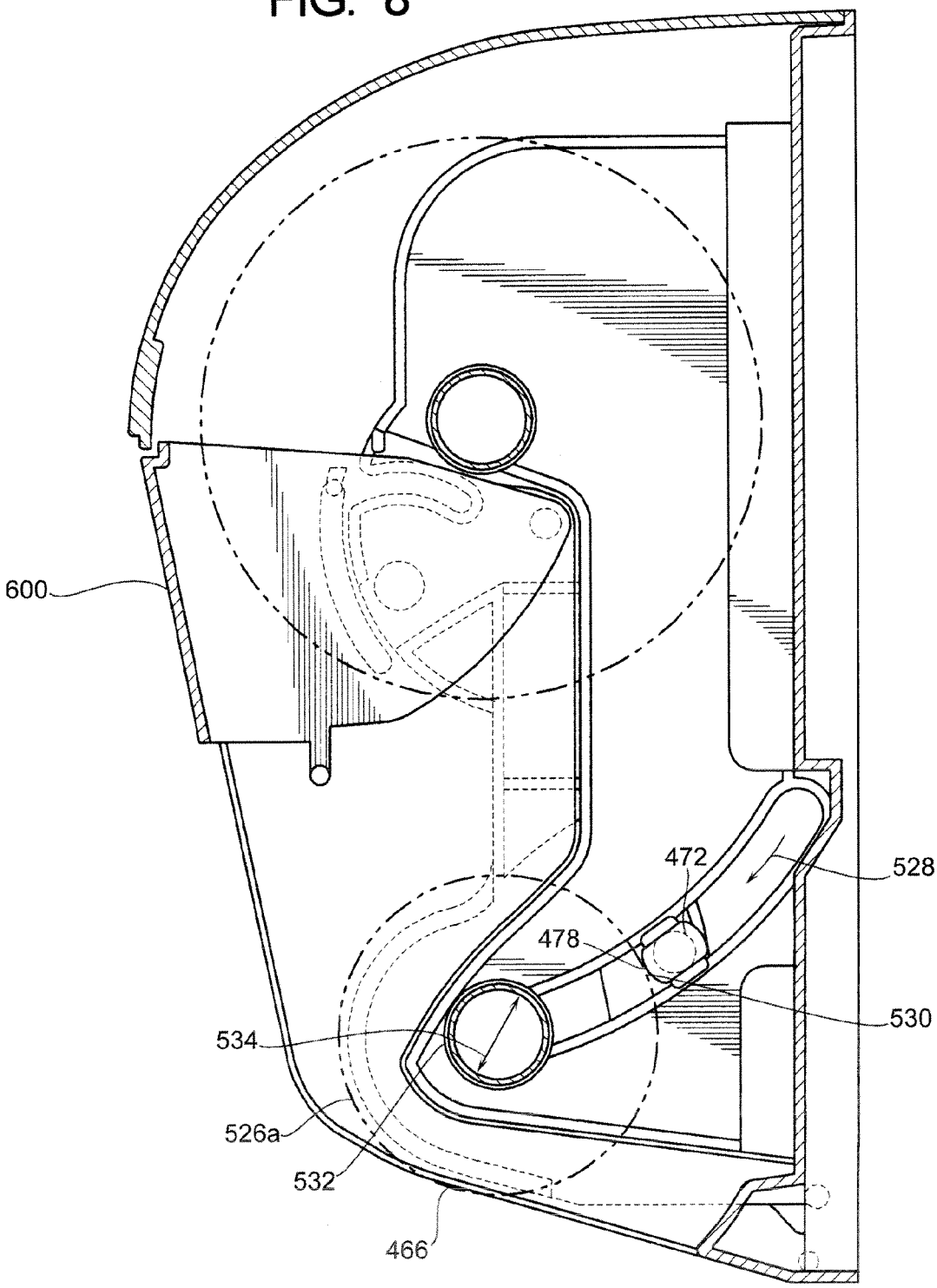
FIG. 8 is a hidden line side view of one embodiment from the left side.
Figure 9:
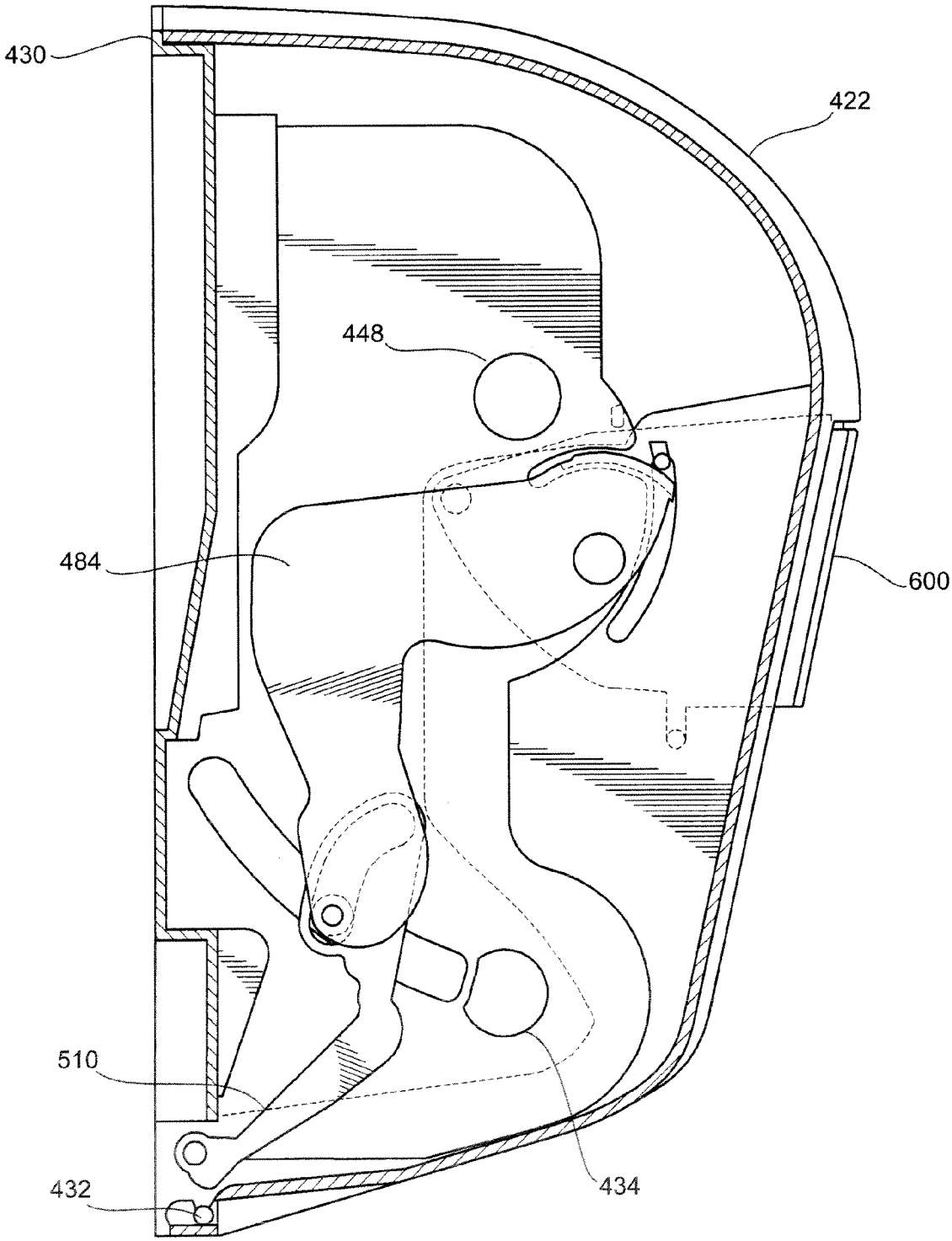
FIG. 9 is a hidden line side view of the right side of one embodiment of the disclosure in a reserve position with the primary roll substantially removed.
Figure 10:
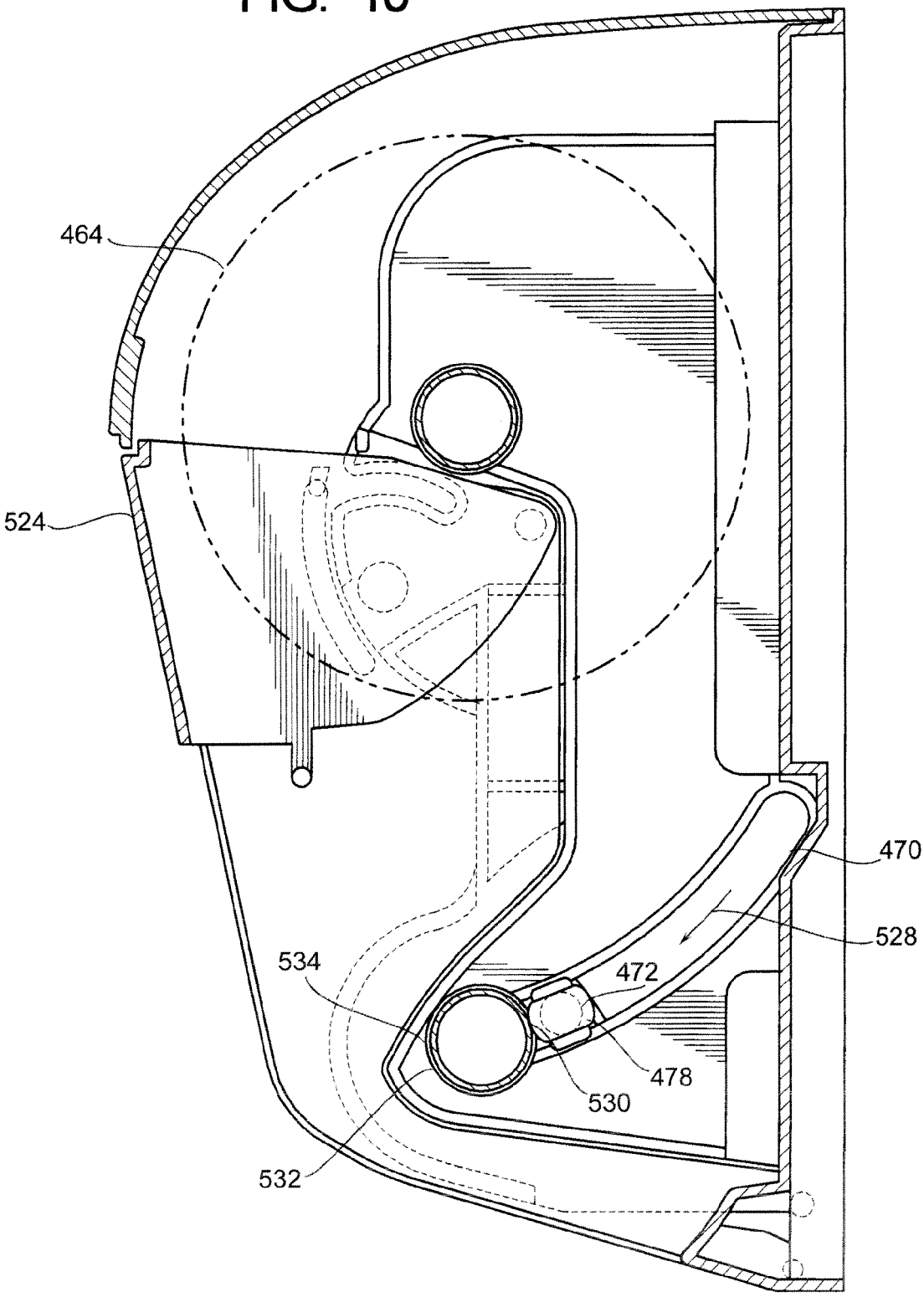
FIG. 10 is a hidden line side view of the left side of one embodiment of the disclosure in a closed and operational position with the primary roll substantially removed showing the secondary lifting mechanism.

Looking at FIG. 8, it can be seen how the swing arm 472 moves in the direction of travel 528 while the outer surface 526*a* reduces in diameter as the primary product roll 466 is consumed. As shown, the engagement portion 478 is engaging the outer surface 526*a* at point 530. As shown, the primary product roll 466 includes a core 532 having an outer diameter 534. In one form, the core 532 is a partial or split core wherein one portion of the core is supported by the primary roll support 434 and any other portions of the core extend from the transverse end 537 of the primary roll support 434 as shown in FIG. 2. Thus, as shown in FIG. 10 wherein the casing door 600 is still in the reserve position 524, the swing arm 472 has traveled in the direction of travel 528 along channel 470 beyond the outer diameter 534 of the core 532. The majority of the swing arm 472 would, of course, not extend beyond the outer diameter 534 of the core 532; however, the engagement portion 478 would extend beyond the outer diameter 534.

As the primary product roll 466 of one embodiment of the disclosure is substantially consumed, the casing door 600 is released, and it rotates from the reserve position 524 as shown in FIG. 10 to the open position 536 as shown in FIG. 12. In this position, a consumer would have access to the outer surface 538 of the secondary product roll 464.

At this stage it would be inconvenient to replace the primary product roll 466 with a new roll as both the secondary product roll 464 and the swing arm 472 could interfere with such action. Thus, an embodiment is disclosed wherein as shown in FIG. 15, as the casing 422 is opened about the pivot point 432 in direction of travel 544, the reset tab 522 engages the reset surface 520 of the lower member 510, which forces the lower member 510 to pivot about the lower member pivot 516 in direction of travel 545 and repositions the swing arm 472 in the direction of travel as shown at 540.

Figure 14:
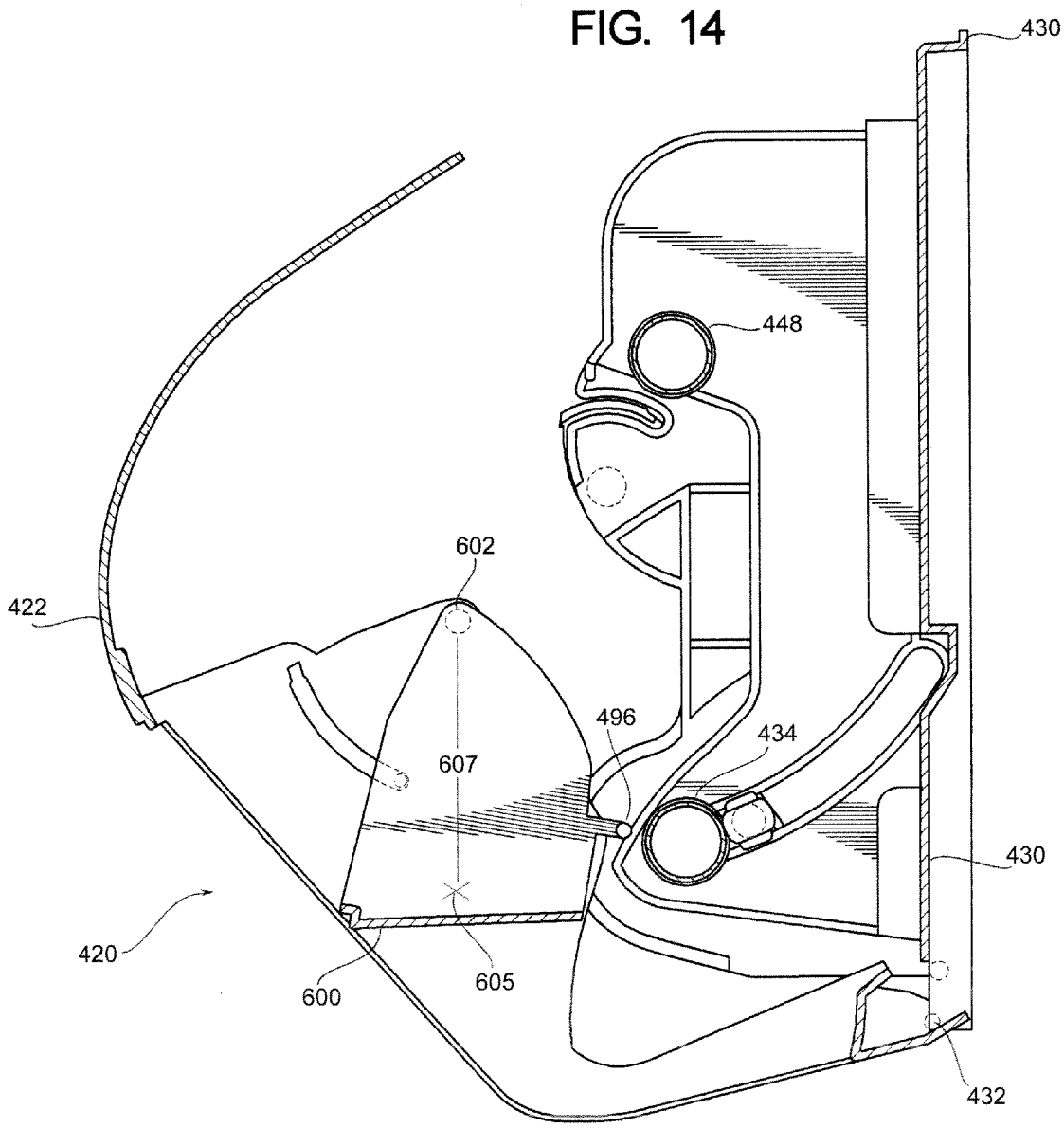
FIG. 14 is a hidden line side view of the left side of one embodiment of the disclosure in a substantially open position.

Now looking at the embodiment shown in FIG. 14, the latching mechanism has been released, and the casing 422 has been partially opened, and rotated about casing pivot 432.

FIG. 15 shows the dispenser 420 in the same position as FIG. 14, but from the right side. In both of these views, it can be seen how the lifting member 496 has moved a short distance away from the primary roll support 434 as the casing 422 is opened. As the casing 422 continues to rotate to a more open position, the casing door pivot 602 will thus be caused to move further from the casing 430. Looking at FIG. 14, it can be seen how as the casing door 600 is allowed to freely pivot about the casing door pivot 602. The center of gravity 605 of the casing door 600 will tend to remain vertically below the casing pivot 602 as the casing 422 is opened and closed. As the casing 422 is opened about casing pivot 432, and the casing pivot 602 moves laterally away from the frame 430, the center of gravity 605 of the casing door 600 will remain in a line 607 which is substantially vertically below the casing pivot 602. Thus the lifting member 496 will tend to be repositioned away from the primary roll support 434. This allows for a primary role of product 466 to be positioned on the primary roll support 434 without the additional effort of moving the casing door 600 nor the lifting member 496.

Figure 16:
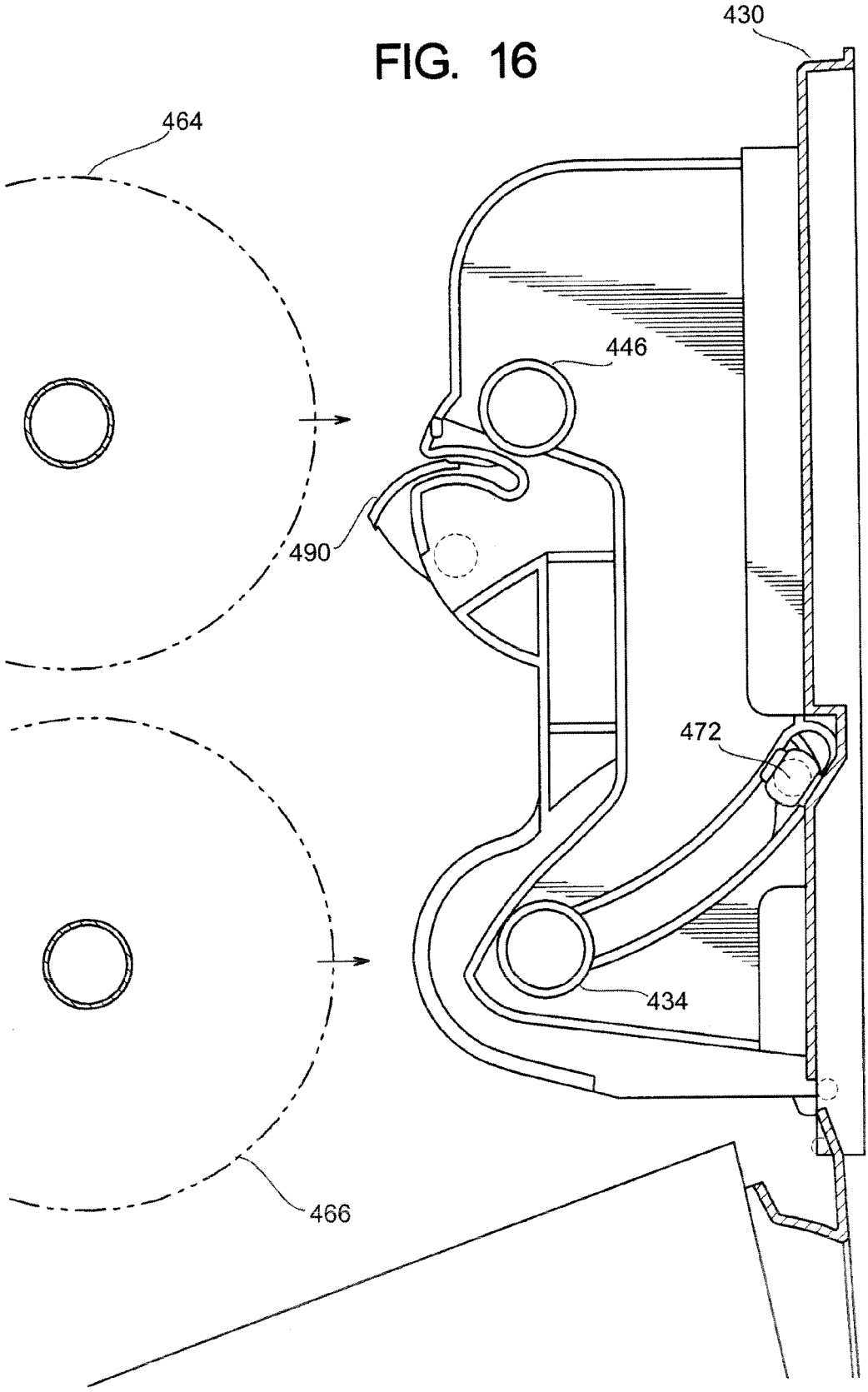
FIG. 16 is a hidden line side view of the left side of one embodiment of the disclosure in an open position and new replacement rolls of product positioned to be inserted in the apparatus.
Figure 18:
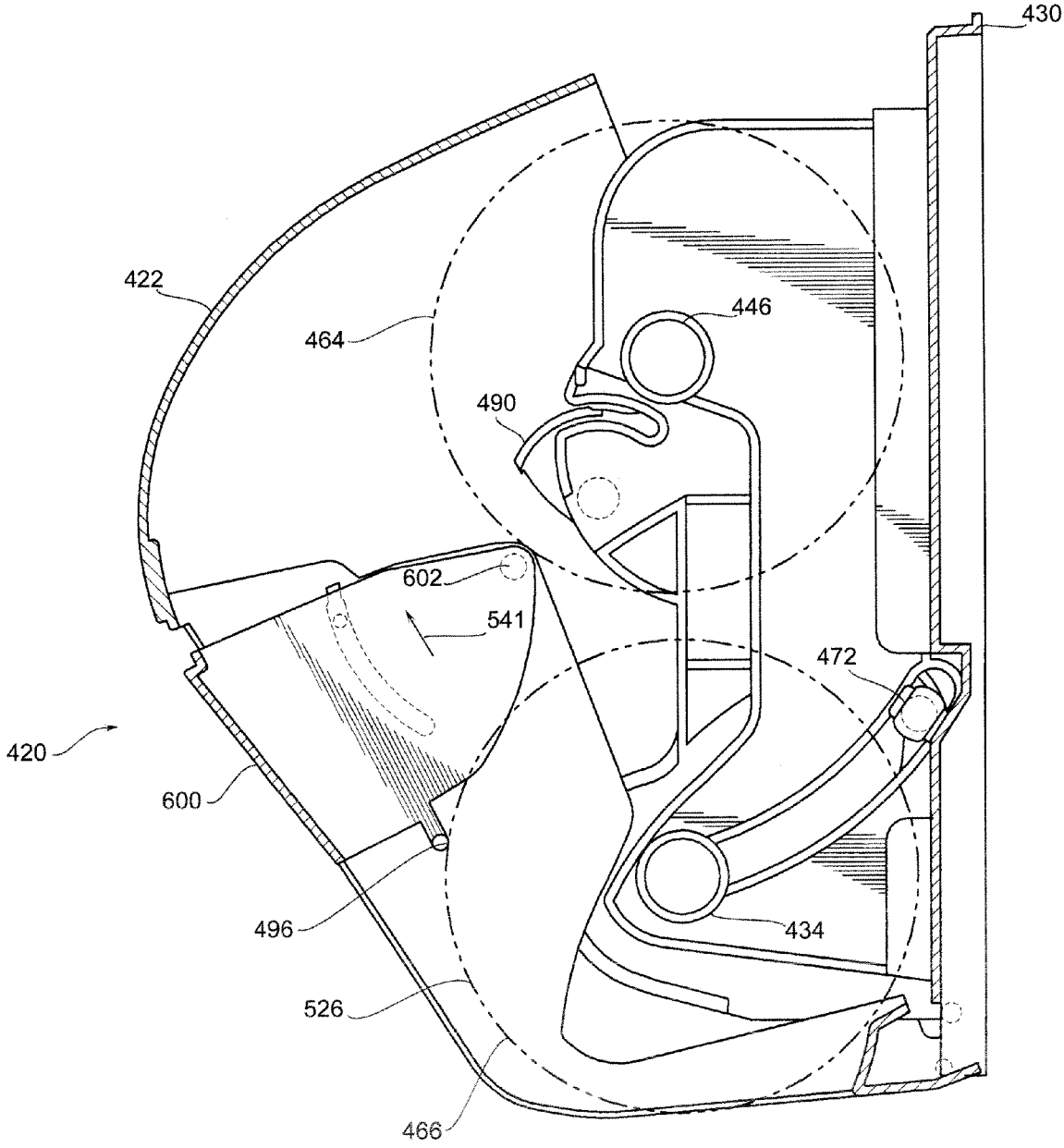
FIG. 18 is a hidden line side view of the left side of one embodiment of the disclosure partially re-closed.
Figure 19:
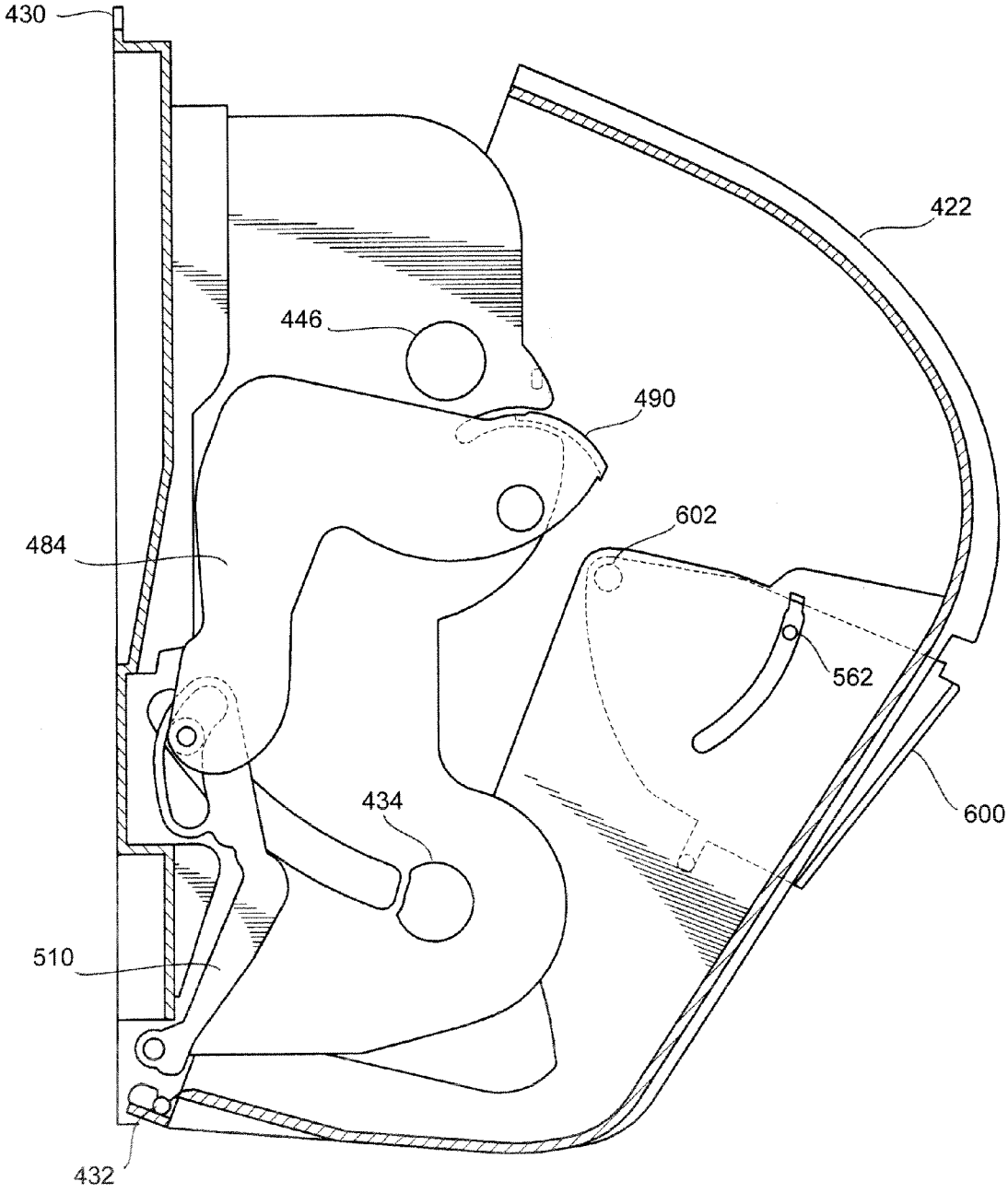
FIG. 19 is a hidden line side view of the right side of one embodiment of the disclosure partially re-closed.

As shown in FIG. 18, the dispenser 420 in one form can be configured such that a lifting member 496 engages the outer surface 526 of the primary product roll 466 which tends to rotate the casing door 600 from an open position 536 to a reserve position 524 as further shown in FIG. 18. The casing door pivot 602 is provided which rotationally couples the casing door 600 to the lateral extension 440. The secondary product roll 464 and/or primary product roll 466 can be replaced as shown in FIG. 16. At this point, the casing 422 could be closed and could reengage the latching mechanism, at which point the apparatus is once again ready for use. Thus, the motion of opening and re-closing the casing 422 repositions the seer mechanism, and the casing door 600 to a reserve position 424.

Figure 20:
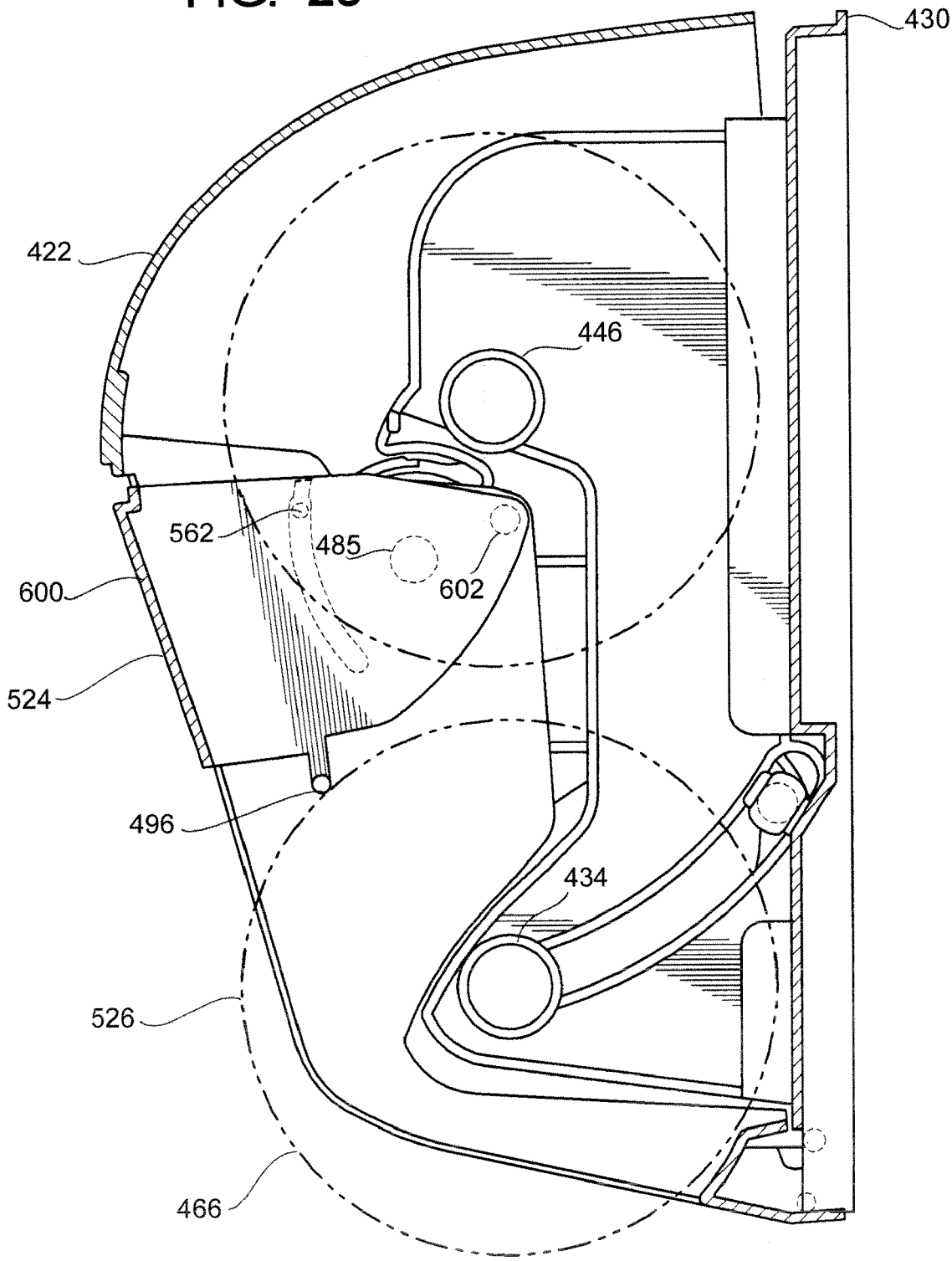
FIG. 20 is a hidden line side view of the left side of one embodiment of the disclosure substantially re-closed.
Figure 21:
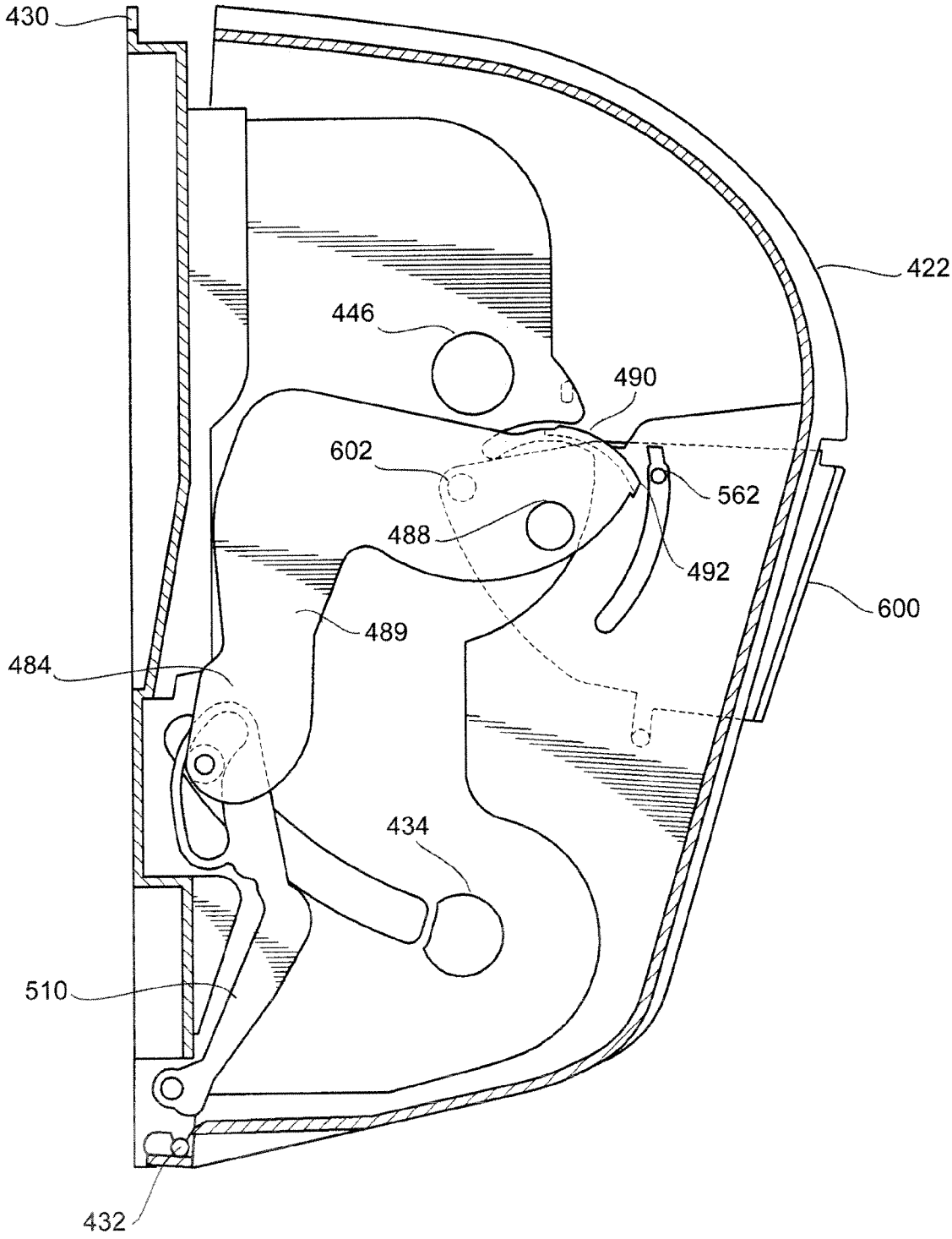
FIG. 21 is a hidden line side view of the right side of one embodiment of the disclosure substantially re-closed.

The specific sequence as shown in FIG. 15, of one embodiment of the disclosure, is that as the casing 422 rotates about case pivot 432 in the direction as indicated at 544, pressure is put upon the lower member 510. The pressure exerted by the casing 422 against the lower member 510 rotates the lower member 510 about lower member pivot 516 in the direction as indicated at 545. This rotation of the lower member 510 exerts force against the swing arm 472 along the channel 418 in the direction of travel 540. As the swing arm 472 in one form is connected to the upper member 484, this force tends to rotate the upper member 484 about the upper member pivot 488 in the direction as indicated at 548. A new primary roll is then positioned upon the primary roll support 434 as shown in FIG. 16. As the casing 422 is re-closed, the lifting member 496 engages the outer surface 526 of the primary roll 466 as shown in FIG. 18. This repositions the casing door 600 to the reserve position 524 of FIG. 20, wherein the secondary product roll 464 is no longer available for use. Looking at FIG. 21, it can be seen how as the casing 422 is re-closed, the seer latch 562 moves past the upper member 484 without engaging the seer point 492, nor the cam surface 490. As shown, the casing door 600 is substantially closed. As the new primary roll is consumed, the lifting member 496 continues to ride on the outer surface 526 of the primary roll 466 as shown in FIG. 20, until the seer latch 562 once again engages the cam surface 490 as shown in FIG. 5. At which point the primary roll 466 no longer engages the lifting member 496, and the secondary product roll 466 is still not available for use (see FIG. 4) until the primary roll 466 is substantially consumed. Thus, the two operations of the reset mechanism 554 are achieved. These operations are: repositioning the swing arm 472 such that a new roll can be placed upon the primary roll support 434 with a minimum of effort, and ensuring the casing door 600 is moved from an operational position 536, as shown in FIG. 12, to a reserve position 524 as shown in FIG. 4. Should the secondary product roll 464 need to be replaced at the same time, that can easily be achieved.

It is also conceived that whereas it may be beneficial to provide the primary product roll with a split or partial core, it may also be desirable to provide the secondary product roll 464 with a full-length core.

Figure 11:
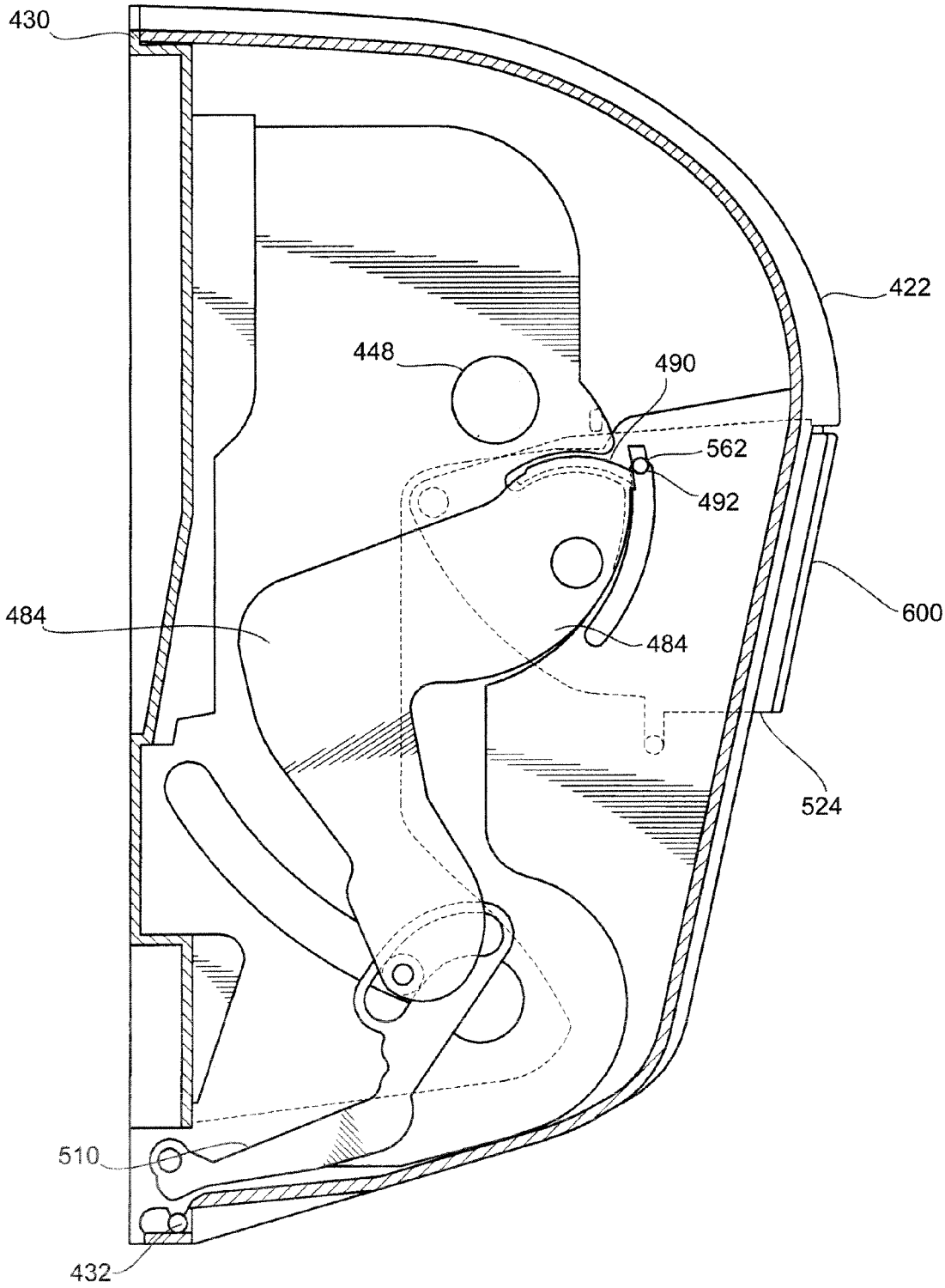
FIG. 11 is a hidden line side view of the right side of one embodiment of the disclosure in a reserve position with the primary roll substantially removed.
Figure 13:
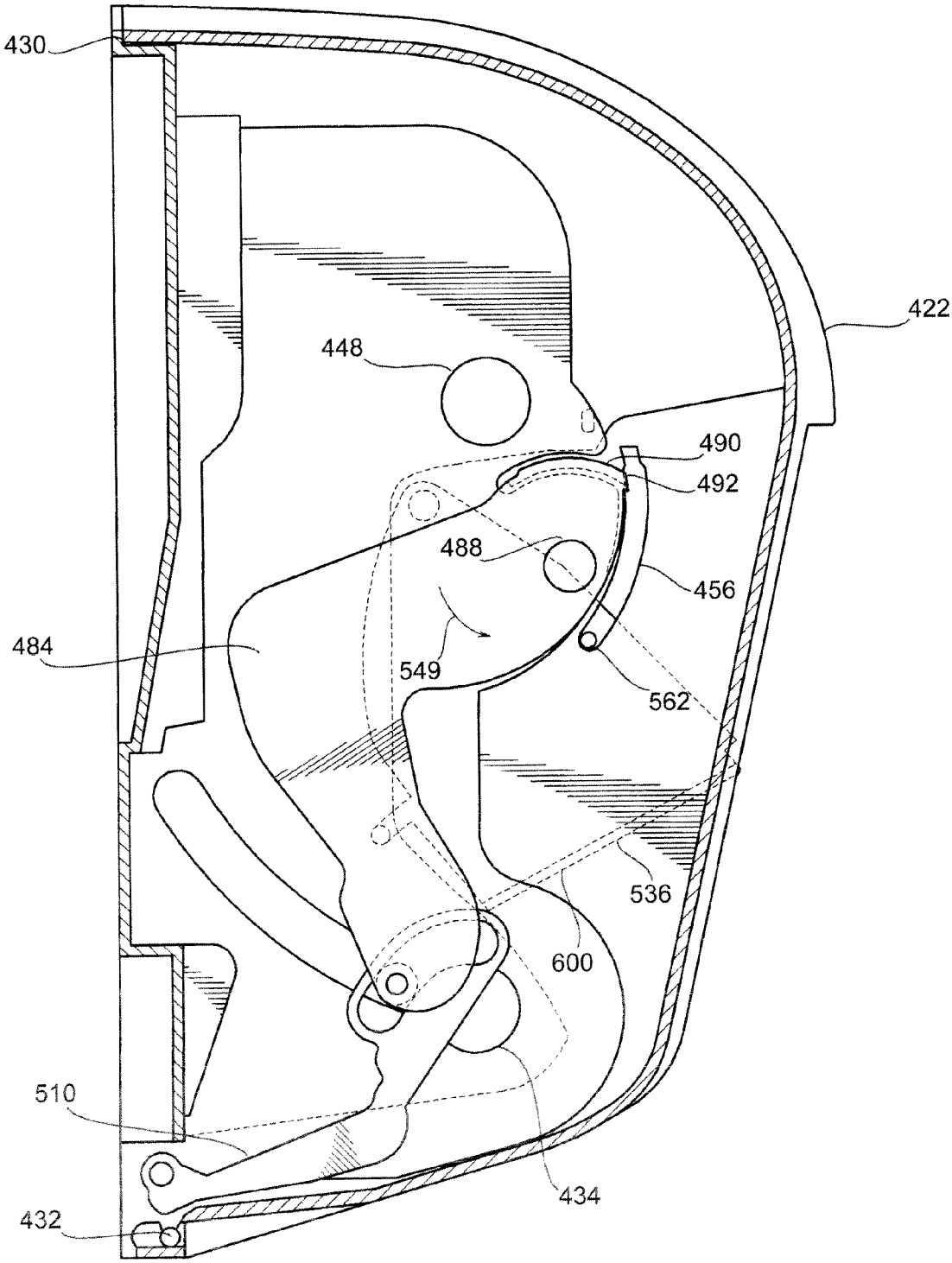
FIG. 13 is a hidden line side view of the right side of one embodiment of the disclosure in a closed and operational position with the primary roll removed and the secondary roll accessible to be utilized.

This particular embodiment of a seer mechanism can further be seen in FIGS. 11 and 13, wherein at FIG. 11 the primary roll is not completely consumed and the casing door 600 is still in its reserve position 524. In FIG. 13 however, the seer latch 562 is no longer in contact with the cam surface 490, and the upper member 484 is rotated in direction of travel 549 such that the seer point 492 has passed beyond the seer latch 562 and has dropped along the channel 456 from the reserve position 524 of FIG. 11 to the operational position 536 of FIG. 13.

Now looking at FIG. 17, the reset mechanism 554 as previously discussed is shown from the right transverse side. As has been previously discussed, the casing 422 is rotated to an open position, and forces are exerted upon the lower member 510 and other associated portions of the reset mechanism 554 to reposition the swing arm 472 to a position furthest from the primary roll support 434. In this form, a primary roll of product is easily positioned upon the primary roll support 434, and a secondary roll of product is easily positioned upon the secondary role support 446.

While the present invention is illustrated by description of several embodiments and while the illustrative embodiments are described in detail, it is not the intention of the applicants to restrict or in any way limit the scope of the appended claims to such detail. Additional advantages and modifications within the scope of the appended claims will readily appear to those sufficed in the art. The invention in its broader aspects is therefore not limited to the specific details, representative apparatus and methods, and illustrative examples shown and described. Accordingly, departures may be made from such details without departing from the spirit or scope of applicants' general concept.

I claim:

1. A paper product dispenser for dispensing products wherein the dispenser comprises:

a) a frame;

b) a casing pivotally coupled to the lower portion of the frame;

c) a casing door configured to be openable;

d) a primary roll support coupled to the frame;

e) a swing arm coupled to the frame and configured to engage the outer surface of a primary roll of product while the primary roll is being utilized; and f) the swing arm further coupled to the casing and operatively configured to reset to a first position as the casing is opened.

2. A paper product dispenser for dispensing product on a plurality of rolls comprising a primary roll and a secondary roll, wherein the dispenser comprises:

a) a frame comprising a face side;

b) a lateral extension having a face side, a back side, and a first end, the lateral extension coupled at the first end to the face side of the frame and extending perpendicular thereto;

c) a primary roll support fixedly coupled to the lateral extension and extending transversely from the face side of the lateral extension, operatively configured to support the primary roll of product;

d) a secondary roll support extending transversely from the face side of the lateral extension, operatively configured to support the secondary roll of product;

e) a casing pivotablv coupled to the frame;

f) a casing door pivotablv coupled to the casing, the casing door configured to deny access to the secondary roll of product until the primary roll of product is substantially consumed, g)wherein the casing door comprises a seer latch, h) a swing arm extending transversely from the lateral extension wherein the swing arm is configured to engage the outer surface of the primary product roll positioned upon the primary roll support and rotate about an pivot point of the lateral extension as the primary roll of product is consumed;

i) the swing arm further coupled to the casing;

j) the swing arm operatively configured be reset to a first position by force exerted by the casing as the casing is opened; and k) wherein the dispenser is operably configured to reposition the casing door from a position where the secondary roll of product is accessible to a reserve position as the casing closed.

3. The paper product dispenser of claim 2 wherein the swing arm is operatively configured to be repositioned to a reserve position, followed by repositioning the casing door to a reserve position, functionally resetting the dispenser.

4. The paper product dispenser of claim 3 wherein the functional reset of the dispenser is accomplished automatically as a casing is pivoted to an open position.

5. The paper product dispenser of claim 2 wherein the swing arm is rotatably coupled to the frame at a first end of a lower member via a lower member pivot and the lower member comprises a channel substantially at a second end of the lower member configured to slidably engage an upper member wherein the channel of the lower member directly engages the swing arm.

6. The paper product dispenser of claim 5 further comprising a casing rotatably attached to the frame at a casing pivot and further comprising a repositioning tab operatively configured to engage a repositioning surface on the first end of the lower member when the casing is opened to a substantially fully open position, wherein pressure against the repositioning surface of the lower member by the repositioning tab will rotate the lower member about the lower member pivot.

7. The paper product dispenser of claim 2 further comprising an upper member rotatably coupled to the back side of the lateral extension slidably engaging the seer latch, the upper member comprising a cam surface and a seer point which are configured to slidably engage the seer latch while the primary product roll is not substantially consumed.

8. The paper product dispenser of claim 2 wherein the swing arm extends transversely from an upper member through a surface defining a channel disposed upon the lateral extension.

9. The paper product dispenser of claim 2 wherein the swing arm further comprises an engagement portion operatively configured to engage the outer surface of the primary product roll until the primary product roll is substantially consumed at which point the seer latch is released and the casing door is repositioned to an open position.

10. The paper product dispenser of claim 9 wherein the swing arm further comprises an engagement portion operatively configured to release the seer latch and thus open the casing door only when the primary roll is completely utilized.

11. The paper product dispenser of claim 2 wherein the frame and the lateral extension are formed as a unitary structure.

12. The paper product dispenser of claim 2 further comprising a lifting member coupled at a first end to the casing door and configured to frictionally engage the outer surface of the primary roll of product as the casing door is closed and thus reposition the casing door from a position where the secondary roll of product is accessible to a reserve position.

* * * * *